US008522508B1

(12) United States Patent
Collins

(10) Patent No.: US 8,522,508 B1
(45) Date of Patent: Sep. 3, 2013

(54) FLASHING SUPPORT CANT FOR A WALL ASSEMBLY AND ASSOCIATED METHOD

(75) Inventor: P. Michael Collins, Cincinnati, OH (US)

(73) Assignee: PACC Systems I.P., LLC, Cincinnati, OH (US)

( * ) Notice: Subject to any disclaimer, the term of this patent is extended or adjusted under 35 U.S.C. 154(b) by 24 days.

(21) Appl. No.: 13/039,380

(22) Filed: Mar. 3, 2011

Related U.S. Application Data

(60) Provisional application No. 61/310,346, filed on Mar. 4, 2010.

(51) Int. Cl.
*E04B 1/00* (2006.01)

(52) U.S. Cl.
USPC ..... 52/745.2; 52/209; 52/61

(58) Field of Classification Search
USPC ..... 52/58, 60, 61, 62, 63, 209, 169.5, 52/169.14, 98, 99, 100, 745.19, 745.2
See application file for complete search history.

(56) References Cited

U.S. PATENT DOCUMENTS

| | | | | |
|---|---|---|---|---|
| 3,585,766 | A | 6/1971 | Jamieson | |
| 3,812,634 | A | 5/1974 | Resech | |
| 3,919,815 | A | 11/1975 | Alabaster | |
| 4,404,777 | A | 9/1983 | Lolley et al. | |
| 4,439,956 | A | 4/1984 | House | |
| 5,189,853 | A * | 3/1993 | Braine et al. | 52/96 |
| 5,794,388 | A * | 8/1998 | Jackman | 52/169.5 |
| 5,815,986 | A * | 10/1998 | Laska | 52/62 |
| 5,927,023 | A * | 7/1999 | Kittilstad | 52/60 |
| 5,970,667 | A | 10/1999 | Thaler | |
| 6,023,892 | A * | 2/2000 | Sourlis | 52/169.5 |
| 6,205,724 | B1 | 3/2001 | Garling et al. | |
| 6,238,766 | B1 * | 5/2001 | Massett et al. | 428/99 |
| 6,244,001 | B1 | 6/2001 | Anastasi | |
| 6,574,930 | B2 | 6/2003 | Kiser | |
| 6,715,237 | B2 | 4/2004 | Batt, Sr. | |
| 6,892,499 | B1 | 5/2005 | Mayle | |
| 7,037,864 | B2 * | 5/2006 | Faucher | 442/86 |
| 7,222,462 | B2 * | 5/2007 | Ellingson | 52/62 |
| 7,421,826 | B2 | 9/2008 | Collins et al. | |
| 7,591,106 | B2 * | 9/2009 | Conlin | 52/58 |
| 7,621,079 | B2 * | 11/2009 | Takagi et al. | 52/169.5 |
| 7,900,404 | B2 * | 3/2011 | Koch et al. | 52/62 |
| 8,046,956 | B1 * | 11/2011 | Hohmann, Jr. | 52/62 |
| 2003/0177712 | A1 | 9/2003 | Gatherum | |
| 2003/0177736 | A1 * | 9/2003 | Gatherum | 52/741.1 |

* cited by examiner

*Primary Examiner* — William Gilbert
*Assistant Examiner* — Gisele Ford
(74) *Attorney, Agent, or Firm* — Wood, Herron & Evans, LLP

(57) ABSTRACT

In various embodiments, this invention includes a wall assembly having an interior generally vertical wall having a wall face, an exterior generally vertical wall confronting and being spaced from the wall face, and a generally horizontal ledge extending perpendicularly to the interior and exterior walls. A cant member is installed above grade on the wall assembly and has a upper portion, a lower portion and a cant portion intermediate the wall and lower portions. The upper portion is juxtaposed in face-to-face relation to the wall face and the lower portion is juxtaposed in face-to-face relation to the ledge with the cant portion extending between the wall and lower portions such that a flashing is supported by the cant and moisture on the wall face of the interior wall is diverted by the cant member along the cant portion toward the exterior wall and away from the wall assembly. The invention also extends to a cant member as described in various embodiments herein as well as a method of constructing a wall assembly.

10 Claims, 4 Drawing Sheets

FLASHING SUPPORT CANT FOR A WALL ASSEMBLY AND ASSOCIATED METHOD

This claims the benefit of U.S. Provisional Patent Application Ser. No. 61/310,346, filed Mar. 4, 2010, and hereby incorporated by reference in its entirety.

BACKGROUND OF THE INVENTION

The invention relates generally to water management systems for reducing water intrusion in structures. More specifically, the invention relates to such systems and configurations for above grade installation in wall assemblies.

Fungus and other molds having known health risks associated with them have been found growing within the walls of homes and buildings. Such molds can, and have, caused a recognized and serious health threat to home owners and building occupants. The growth of such molds can be facilitated by moisture seeping within the walls of homes and buildings. Conventionally, keeping moisture out of human-built structures has been an ongoing goal. Since mold spores have been found to be a serious health risk of late, due to increased incidence of moisture ingress in newer construction systems, preventing moisture from entering the walls of homes and buildings is considered much more serious and widespread concern than it has previously.

Wherever changes in wall planes exist, for example where there is a vertical to horizontal transition or a gap between wall components, supporting a membrane flashing at the transition or gaps has been mostly ignored by the associated trades. The areas where the walls of a building meet the foundation or a ledge, particularly in wood frame construction and the gaps between walls and fixtures, have been recognized as areas where water can enter unsupported membrane flashing gaps and therefore fail, because a construction joint of some type typically is provided there. For these and other reasons, the problem of moisture ingress is well recognized in the trades and in the field of architectural design.

The common solution for this problem is to install unsupported membrane flashing. However, this solution is costly because it is labor intensive. Further, if the flashing is not properly installed, such as by a careless or unskilled worker, water can leak at a sagged and failed flashing and into the open upper end of the frame member.

One identified problem is where there would be a negative pitch back toward the interior side of the flashing assembly caused by construction irregularities. Currently a cant is typically formed with materials that are mixed, applied and shaped, and then harden to support a membrane. While this method is used extensively below grade, the trades involved with installing flashing above grade often dispense with the mixed version of the cant in favor of none at all because of timing sensitivity in completing the installation and construction.

Thus, there is a need for a system that supports flashing at changes in wall planes and between gaps in materials where the solution is not labor intensive and can be easily and effectively installed by unskilled labor.

SUMMARY OF THE INVENTION

It has been recognized that further improvement in water management at critical areas such as those mentioned above will yield benefits of lower incidence of harmful mold spores, dry rot and other structural damage; decreased incidence of interior water damage such as unsightly stains, etc. Further, cost savings to builders, who will have fewer costly repairs to new construction, and to homeowners, who will have less costly repairs after a builder's warranties have expired, will be realized by more reliably excluding water from the structure.

This invention addresses these and other problems in the art. In various embodiments, this invention is designed to create a cant or sloped plane for water management at the transition of vertical to horizontal components in a wall and bridging gaps between wall components to maintain the directional flow of water from the wall assembly.

In one embodiment, this invention is a cant member made from a corrugated metal or polypropylene sheet that has eight slits or scores across the front face and two slits or scores across the back face of the sheet that are parallel with the corrugations. The slits allow for bending of the member at a number of selected, predetermined locations. The back or inner face of the member has adhesive strips, covered with a release sheet, for adhesion of the member to the related substrate. The invention can be utilized in a number of different installation environments. As used herein, a cant member is a member having an inclination from a vertical or horizontal plane such as a sloped, slated, tilted or oblique member.

In various embodiments, the cant member is metal or polypropylene which will be preformed into 45-degree angle between a upper portion and an adjacent 3-inch section. It is anticipated the 3-inch section of the metal piece will be corrugated the same as a polypropylene piece in an alternate embodiment. This will provide a similar bending ease along the corrugations in the metal as with the polypropylene version.

The method of attachment for the cant member is, in one embodiment, a peel and stick adhesive or fasteners suitable for attachment to the substrate. The method of attachment will hold the cant member in place long enough to be covered by a membrane flashing.

Overall, the benefits to a user of this invention include a lower possibility of a negative pitch, and to keep water moving in an outward direction from the structure, and to support an otherwise weak membrane at a gap. An unsupported membrane flashing will fail over time. Additionally, the cant member of this invention can be rotated to accommodate a variety of different applications and as such simplifies construction and purchasing.

In various embodiments, this invention includes a wall assembly having an inner generally vertical wall having a wall face, an outer generally vertical wall confronting and being spaced from the wall face, and a generally horizontal ledge extending perpendicularly to and between the inner and outer walls. A cant member is installed on the wall assembly and has an inner wall or upper portion, a ledge or lower portion and a cant portion intermediate the upper and lower portions. The inner wall upper portion is juxtaposed in face-to-face relation and adhered or fixed to the wall face and the lower portion is juxtaposed and adhered or fixed in face-to-face relation to the ledge with the cant portion extending between the upper and lower portions such that the cant member may support a flashing member mounted to direct moisture toward the exterior wall and away from the wall assembly.

The invention also extends to a cant member as described in various embodiments herein as well as a method of constructing a wall assembly and the resulting wall assembly.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
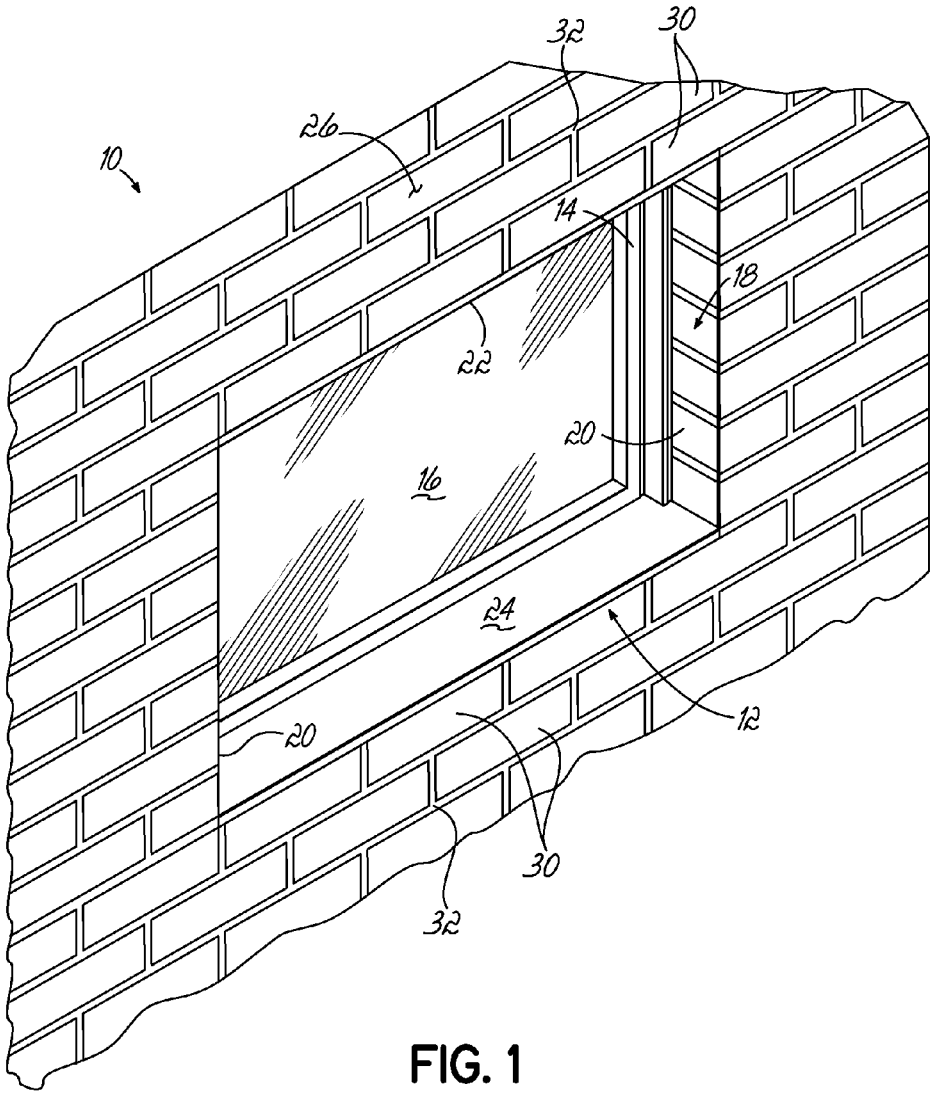
FIG. 1 is a perspective view of one environment in a cavity wall in which this invention may be used.

Referring to FIG. 1, an exemplary fixture installation 10 in a wall assembly 12 is shown. The exemplary fixture installation 10 includes a perimeter window frame 14, one or more window panes 16, and a window opening 18 in the wall defined by a pair of jambs 20 and a header 22 above and a sill 24 below the window frame 14. Although one example of a window installation and a wall assembly 12 is shown in FIG. 1, this invention is readily applicable for a variety of other construction wall environments, including, but not limited to, door installations, installations including a transition of the wall assembly from vertical to horizontal planes and bridging gaps between vertical wall components.

Figure 3:
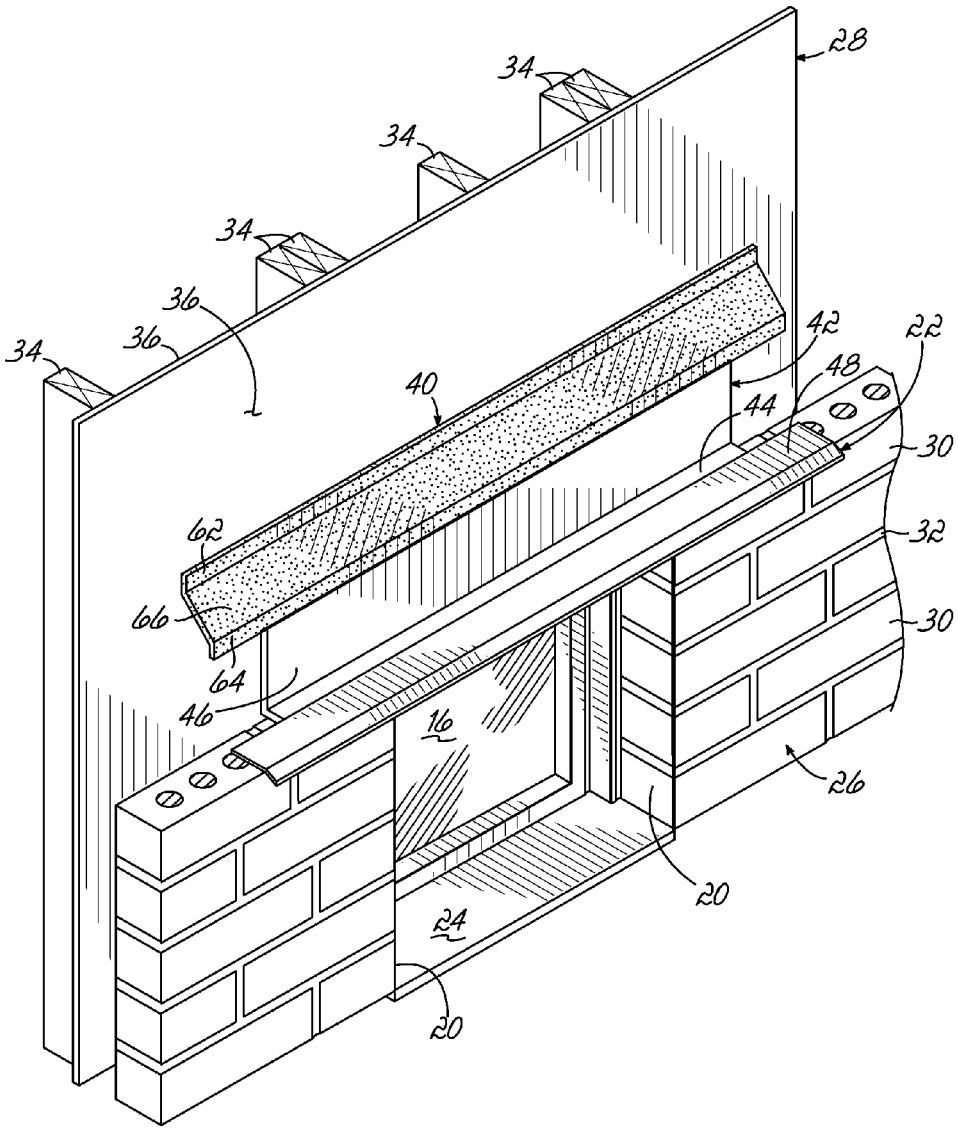
FIG. 3 is a perspective view of a cant member being installed onto an exemplary installation similar to that of FIG. 1 under construction.
Figure 4:
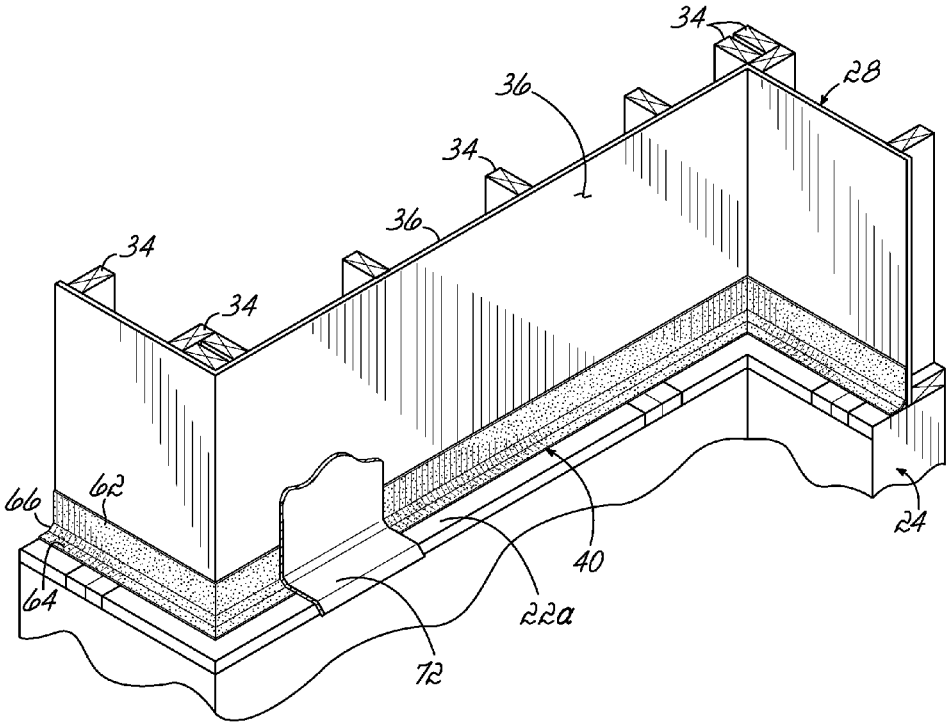
FIG. 4 is a perspective of a cant member installed onto a ledge of a cavity wall installation according to another embodiment of this invention.

As shown more clearly in FIGS. 3-4, one embodiment of the wall assembly 12 for the exterior of a building is comprised of an exterior wall of masonry or brick veneer 26 and an interior wall 28. The brick veneer exterior wall 26 is constructed from a plurality of bricks or blocks 30 arranged in a vertical pattern. Each brick 30 is of a substantially rectangular shape having a uniform length, height and depth. The brick veneer 26 is built up by placing one layer of bricks 30 over another layer, with the upper layer vertically offset from the lower layer by a distance of approximately one-half the length of a brick 30. Thus, as shown in FIGS. 1 and 3, a brick 30 on one layer is positioned directly over the space between two bricks 30 on the layer immediately beneath it. The spaces between adjacent bricks 30 and between adjacent layers of bricks are filled with mortar 32. Alternatively, the veneer 26 may be stone, stucco or other components.

The interior wall 28 includes wood framing studs 34, dry wall, plywood or the like 36, and an outer sheathing material (not shown). Other materials may be used as is well known in the art. For example, a liner board (not shown) as disclosed in U.S. Pat. No. 7,421,826, issued Sep. 9, 2008 and hereby incorporated by reference, may be used on the interior wall 28. In any event, the wall assembly 12 is constructed so that there is a small cavity or airspace A between the back side of the exterior wall 26 and a wall face 38 of the interior wall 28 confronting the outer wall 26. The airspace A between the back side of the outer wall 26 and the wall face 38 of the interior wall 28 is usually at least about one to two inches deep, although the exact dimension may vary depending upon the nature of the construction.

Figure 2:
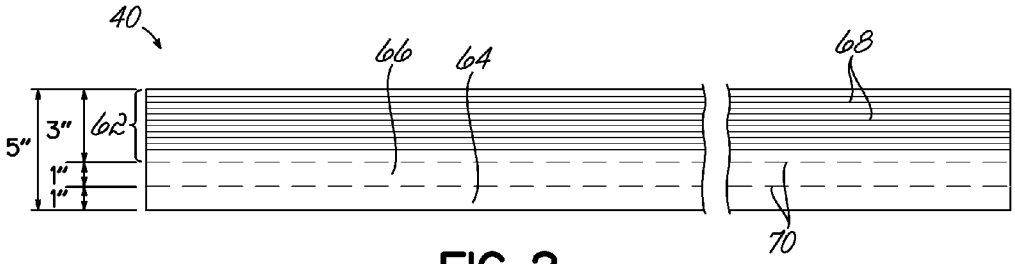
FIG. 2 is a front plan view of one embodiment of a cant member according to this invention.

A first embodiment of a cant member 40 is shown in FIG. 2 and as installed in the wall assembly 10 of FIG. 3 to provide a proper transition from the wall 12 to a fixture, one example of which is the window frame 14. The cant member 40 is installed at the header 22 of the fixture opening 18 in cooperation with the corresponding portions of the fixture frame 14 to provide a transition from the vertical wall 28 to a ledge. As shown in FIG. 3, a steel or other material angle member 42 is typically provided at the header 22 above the frame 14 adjacent the interior wall 28 and extending along the outer wall face 38 of the interior wall 28. The angle member 42 has a horizontal portion 44 extending forwardly from the interior wall 28 to form the header 22 and a vertical portion 46 forms one embodiment of a ledge and extending upwardly along the wall face 38. The vertical portion 46 is typically spaced from the interior wall 28. A drip edge 48 is typically positioned distally on the horizontal portion 44 to extend forwardly at its terminal edge of the exterior wall 26.

Figure 2A:
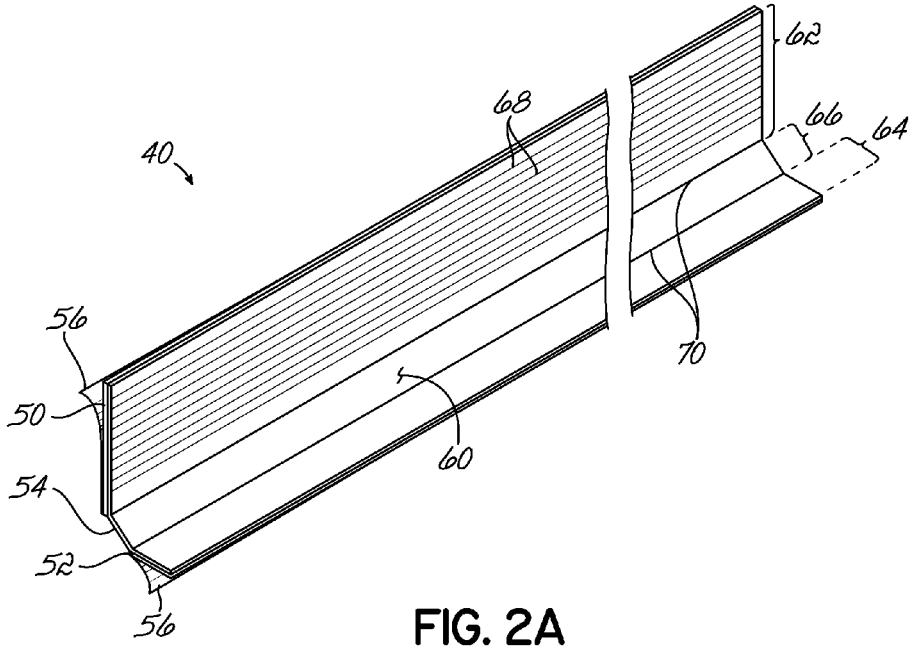
FIG. 2A is a perspective view of the cant member of FIG. 2 bent into an exemplary installation configuration.

In one embodiment as shown in FIGS. 2-2A, the cant member 40 of this invention is a corrugated metal or polypropylene sheet with one or more adhesive layers 50, 52 on a back, inner face 54 thereof that are covered with separate silicone-faced release layers 56, 58. The cant member 40 may have a thickness of 2 mM (85 mil) and an indeterminate length so that it can be cut to length to fit the installation requirements. The embodiment of the cant member 40 shown in FIGS. 2-2A is of indeterminate length as shown by the broken lines in those drawings. In one embodiment, the width of the cant member 40 is approximately five inches and the width of the upper portion 62 is approximately three inches and the widths of the cant and lower portions 66, 64 are approximately one inch each. The cant member 40 will be cut to length as required for the desired wall assembly 12 installation. Where more than one piece of the cant member 40 is needed, the ends of adjacent pieces can be cut to complimentary, mating configurations, if needed, and the ends of those pieces butt together to form the cant installation. While not shown herein for clarity, various flashing members may be mounted on top of the cant member 40 in practice and the cant portion 66 provides a stable support for such flashing members at the transition region from the interior wall 28 to the ledge in the form of a vertical portion 46 (FIG. 3) or a horizontal ledge 22*a* (FIG. 4).

The cant member 40 according to the shown embodiment includes an outer face 60 spaced from and generally parallel with the inner face 54. The cant member 40 has a number of spaced membranes (not shown) extending between the inner and outer faces 54, 60 and forming a number of corrugations extending longitudinally along a length of the cant member 40. The inner face 54 of the cant member 40 is adapted to confront and be juxtaposed in face-to-face relation with the various components of the wall assembly 12. The outer face 60, or at least portions thereof, is adopted to support various flashing members installed on top of the cant member 40. The cant member 40 includes a wall or upper portion 62 extending longitudinally, a lower portion 64 likewise extending longitudinally and spaced from the upper portion 62 and a cant portion 66 also extending longitudinally and positioned intermediate and joining the upper and lower portions 62, 64 on the member 40. As the names imply, the wall or upper portion 62 is intended to be oriented generally vertically and juxtaposed to the interior wall 28 of the wall assembly 12 when the cant member 40 is installed and, likewise, the lower portion 64 is adapted to be oriented generally horizontally and juxtaposed against the generally horizontal ledge 22 of the wall assembly 12 or a vertical portion of the wall assembly 12. The cant portion 66 between the wall and lower portions 62, 64 of the flashing member 40 is intended to extend between the wall and vertical or horizontal portions and to be oriented generally at a 45° or other angle oblique to the interior wall 28, vertical portion 46 or ledge 22, 22*a* of the wall assembly 12 in this embodiment.

The cant member 40 includes the layer of adhesive 50 on the inner face 54 of the upper portion 62 to secure the cant member 40 to the interior wall 28. The layer of adhesive 50 is covered by a layer of release paper 56 adapted to be removed from the adhesive layer 50 (FIG. 2A). Additionally, a second layer of adhesive 52 is positioned on the inner face 54 of the cant member 40 in the lower portion 64 which is likewise covered by a layer of release paper 56.

The outer face 60 of the upper portion 62 of the cant member 40 includes a series of generally parallel scores or slits 68 extending longitudinally. The slits 68, eight of them in one embodiment, permit a portion of the cant member 40 to be shaped to conform to the configuration of the interior wall 28 for proper positioning and adhesive application to the interior wall. A pair of scores or slits 70 are formed on the inner face 54 of the cant member 40, one at the juncture between the upper portion 62 and the cant portion 66 and another at the juncture between the lower portion 64 and the cant portion 66 to allow for easy manipulation of the cant member 40 for configuration into the orientation shown in FIG. 2A from the generally planar orientation shown in FIG. 2. A slit or score may also be provided on the outer face 60 at the juncture between the cant and lower portion 64, 66 to enable the cant member 40 to bend into the configuration shown in FIG. 3.

When properly positioned in the wall assembly 12, the inner face 54 of the upper portion 62 should be generally flat against the vertical, interior wall 28 and the inner face 54 of the lower portion 64 should be generally horizontal and flat against the ledge 22 of the wall assembly 12 with the cant portion 66 connecting the upper and lower portions at about a 45° angle. With the cant member 40 generally oriented in this configuration as shown in FIG. 2A, the release paper 56 from the layer of adhesive 50 on the inner face 54 of the upper portion 62 can be removed while maintaining proper orientation of the flashing member 40 in the wall assembly 12. Once the position of the cant member 40 is confirmed and alignment with respect to the lower portion 64 is maintained, then the release paper 58 can be removed from the lower portion 64 and the cant member 40 pressed into position in the wall assembly 12 and being adhered thereto by the layers of adhesive 50, 52. Alternatively, flathead or other mechanical fasteners can be used to secure the cant member 40 in place The forward edge of the lower portion 64 relative to the drip edge when initially installed in the wall assembly 12 should be located and any excess of the lower portion 64 extending beyond the drip edge 48 should be trimmed. In an alternative wall assembly installation shown in FIG. 3, the orientation of the lower portion 64 may be generally vertical or angled obliquely relative to the horizontal plane so as to conform to the downwardly turned lip of the drip edge 48.

The orientation and installation of the cant member 40 as shown in FIG. 4 may require miter cut joints of the adjacent portions of the flashing member 40 at the interior and exterior corners of any such installations in the wall assembly 12. Otherwise, the installation of the cant member 40 is similar to that described herein above with respect to FIG. 3. Exemplary, but non-limiting, types of installations according to FIG. 3 include veneer along shelf angles and veneer heads at non-flanged windows, doors and fixtures. Typically, the horizontal spacing between the vertical components 36 and 46 in FIG. 3 is at least ⅛". Alternatively, the cant member 40 can be installed once rotated from top to bottom to accommodate different applications and installation configurations while satisfying construction, inventory and purchasing requirements.

The cant member 40 of this invention is intended to be at least partially covered by a flashing member 72 and support that flashing member 72, particularly along the cant portion 66 of the cant member 40 underlying the flashing member 72 (FIG. 4). An unsupported flashing member 72 will fail over time and the proper use of the cant member 40 inhibits such a failure. Exemplary, but non-limiting, types of installations in which the cant member of this invention as shown in FIG. 4 include veneer ledges, veneer risers, veneer at a wall to slab interface, veneer sills at flanged windows, doors and fixtures, veneers above lintels, veneers at wall to roof intersections, parapet wall at roof intersection, veneer at deck framing and applied exterior finish sills or thresholds at flanged windows, doors and fixtures.

As such, with this invention in anyone of various embodiments, the cant member is adapted for use specifically in above grade through wall flashing installations. It is a supporting component for adhered or non-adhered flashing membranes that are the waterproofing part of a flashing assembly. The cant member itself is not a flashing device, but a device that supports a flashing member at gaps between walls and fixtures, i.e. angle irons, and at transitions from vertical to horizontal or spaced vertical planes typically located at a bottom of a wall section. The cant member also maintains a directional flow of water toward the exterior face of a wall, over the more important flashing parts, namely the membrane and exposed hard surface drip edge. Without the aid of a supporting cant member of this type, the flow of water could be trapped in undulations along the supporting horizontal leg of the flashing or where there would be a negative pitch back toward the interior side of the flashing assembly caused by construction irregularities. This invention avoids the problems associated with known cant devices typically formed with 2-part materials that are mixed, applied and shaped, and then harden to support a flashing membrane. While this method is used extensively below grade, the trades involved with installing flashing above grade often dispense with the prior mixed version of the cant in favor of none at all because of timing sensitivity. This invention is an above grade answer to the inconvenience of mixing, applying, shaping and waiting for a material to harden.

While the cant member has been shown herein in various environment and installations, it is not limited to any particular environment such as windows and doors, but is applicable for use at the transition of vertical to horizontal wall assembly components in general and bridging gaps between spaced, vertical wall components. Furthermore, the method of attachment for the cant member is not limited to any particular method, but any method effective to hold the cant member in place long enough to be covered by a flashing member is envisioned.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A method of constructing a wall assembly having an inner wall with a wall face and a second component spaced outwardly there from, the method comprising the steps of:

attaching an upper portion of a flashing support cant member to the wall face of the inner wall;

bending the flashing support cant member such that a cant portion of the flashing support cant member adjacent to the upper portion is non-orthogonal to the wall face;

bending the flashing support cant member such that a lower portion of the flashing support cant member adjacent to the cant portion is non-orthogonal to the cant portion;

attaching the lower portion to the second component; and installing a flashing member onto the flashing support cant member such that at least a portion of the flashing member is juxtaposed to and supported by the cant portion of the flashing support cant member;

wherein the bending steps of the flashing support cant member are independent of manipulation of the flashing member.

2. A wall assembly comprising:

an interior generally vertical wall having a wall face;

an exterior generally vertical wall confronting and being spaced from the wall face;

a ledge oriented either parallel or perpendicular to the interior wall;

a flashing member to divert moisture on the wall face of the interior wall toward the exterior wall and away from the wall assembly; and a flashing support cant member underlying and supporting the flashing member and having an upper portion, a lower portion and a cant portion intermediate the upper and lower portions;

wherein the upper portion is juxtaposed in face-to-face relation to the wall face and the lower portion is juxtaposed in face-to-face relation to the ledge with the cant portion extending between the upper and lower portions at a non-orthogonal angle to the upper and lower portions;

wherein the flashing support cant member is a separate and discrete component and incommensurate from the flashing member and the flashing member substantially covers the lower portion of the flashing support cant member.

3. The wall assembly of claim 2 wherein the flashing support cant member is corrugated with a plurality of corrugations oriented generally parallel with the ledge.

4. The wall assembly of claim 2 wherein the flashing support cant member further comprises:

a plurality of scores in one or both of inner and outer faces of the flashing support cant member.

5. The wall assembly of claim 4 wherein the flashing support cant member further comprises:

a first set of a plurality of scores in the outer face of the upper portion.

6. The wall assembly of claim 4 wherein the plurality of scores are generally parallel with and spaced from one another and extend horizontally on the flashing support cant member.

7. The wall assembly of claim 5 wherein the flashing support cant member further comprises:

a second set of a plurality of scores, the second set being on the inner face of the flashing support cant member, one of the second set of scores being at a juncture between the lower portion and cant portion and another one of the second set of scores being at a juncture between the cant portion and the upper portion of the flashing support cant member.

8. The wall assembly of claim 4 further comprising:

a first set of scores on the outer face of the flashing support cant member; and a second set of scores on the inner face of the flashing support cant member;

wherein the first and second sets of scores are on different portions of the flashing support cant member from one another.

9. The wall assembly of claim 2 wherein the flashing support cant member further comprises:

a first layer of adhesive on the upper portion to adhere the upper portion to the interior wall; and a second layer of adhesive on the lower portion to adhere the lower portion to the ledge.

10. The wall assembly of claim 2 wherein the ledge is generally parallel to and spaced from the wall face of the inner wall.

* * * * *